US011097871B2

(12) United States Patent
Tsuda

(10) Patent No.: US 11,097,871 B2
(45) Date of Patent: Aug. 24, 2021

(54) SYNTHETIC RESIN CONTAINER

(71) Applicant: YOSHINO KOGYOSHO CO., LTD., Tokyo (JP)

(72) Inventor: Naoki Tsuda, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/609,730

(22) PCT Filed: Mar. 14, 2018

(86) PCT No.: PCT/JP2018/009986
§ 371 (c)(1),
(2) Date: Oct. 30, 2019

(87) PCT Pub. No.: WO2018/220944
PCT Pub. Date: Dec. 6, 2018

(65) Prior Publication Data

US 2020/0062457 A1 Feb. 27, 2020

(30) Foreign Application Priority Data

May 31, 2017 (JP) ..... JP2017-108187

(51) Int. Cl.
*B65D 35/08* (2006.01)
*B65D 1/02* (2006.01)
*B65D 1/32* (2006.01)

(52) U.S. Cl.
CPC ..... *B65D 35/08* (2013.01); *B65D 1/0207* (2013.01); *B65D 1/0223* (2013.01); *B65D 1/32* (2013.01); *B65D 2501/0081* (2013.01)

(58) Field of Classification Search
CPC .... B65D 35/08; B65D 1/0207; B65D 1/0223; B65D 1/32; B65D 1/0292; B65D 75/008
(Continued)

(56) References Cited

U.S. PATENT DOCUMENTS 3,213,913 A * 10/1965 Petriello ..... B65D 88/62 383/120
3,229,014 A * 1/1966 Petriello ..... B29D 22/003 264/250

(Continued)

FOREIGN PATENT DOCUMENTS

EP 0 375 943 A1 7/1990
GB 2 273 485 A 6/1994

(Continued)

OTHER PUBLICATIONS

May 22, 2018 International Search Report issued in Internatinoal Patent Application No. PCT/JP2018/009986.

(Continued)

*Primary Examiner* — Paul R Durand
*Assistant Examiner* — Michael J. Melaragno
(74) *Attorney, Agent, or Firm* — Oliff PLC

(57) ABSTRACT

A synthetic resin container includes a mouth portion and body, the body being squeezed to discharge contents. The body has a flattened shape with a width larger than a thickness. An end on one side in an axial direction along a center axis line of the body is connected to the mouth portion, and an end on another side is closed and formed in a curved shape protruding toward the other side in the axial direction. Each widthwise ends of the body is provided with a bent portion extending in parallel with the axial direction. When the body is squeezed in the thickness direction to discharge the contents, the bent portion is configured to be a starting point when one of a front side wall and a rear side wall opposed to each other in the thickness direction of the body is inverted and deformed toward the other.

16 Claims, 4 Drawing Sheets

(58) Field of Classification Search
USPC ..... 222/95; 215/381, 900
See application file for complete search history.

(56) References Cited

U.S. PATENT DOCUMENTS 3,894,538 A * 7/1975 Richter ..... A61M 5/14276 604/891.1
4,034,896 A * 7/1977 Wilson ..... B05B 9/047 222/95
4,232,721 A * 11/1980 Martin ..... A61J 1/10 383/120
4,252,257 A * 2/1981 Herzig ..... B65D 47/2031 222/213
4,486,379 A * 12/1984 Wilkie ..... B29C 49/00 264/523
5,080,260 A * 1/1992 During ..... B29C 49/48 222/107
5,090,963 A * 2/1992 Gross ..... A61M 5/155 604/132
5,242,406 A * 9/1993 Gross ..... A61M 5/155 604/132
5,261,565 A * 11/1993 Drobish ..... B65D 47/2075 222/95
5,301,840 A * 4/1994 Sun ..... B65D 25/54 222/109
5,810,202 A * 9/1998 Hoback ..... A61M 5/1486 222/209
6,168,041 B1 1/2001 Berger et al.
D451,809 S * 12/2001 Jones ..... D9/521
D485,764 S * 1/2004 Bakic ..... D9/521
D489,266 S * 5/2004 Shih ..... D9/521
6,776,307 B1 * 8/2004 Hagihara ..... B65D 75/48 222/107
7,445,131 B2 * 11/2008 Pottish ..... B65D 35/08 222/1
2005/0072752 A1 * 4/2005 Yamanaka ..... B65D 1/0292 215/381
2007/0047851 A1 * 3/2007 Sato ..... B29C 66/1122 383/104
2007/0278114 A1 * 12/2007 Kane ..... B65D 25/08 206/219
2012/0216918 A1 * 8/2012 Tsuda ..... B65D 21/086 141/311 R
2012/0267388 A1 * 10/2012 Tom ..... B65D 83/0055 222/1
2015/0108015 A1 * 4/2015 Murray ..... B65D 81/26 206/205
2016/0031720 A1 * 2/2016 May ..... C02F 1/003 210/244
2017/0239873 A1 * 8/2017 Hatakeyama ..... B32B 27/08
2020/0231353 A1 * 7/2020 Van Den Hoonaard ..... B65D 47/08

FOREIGN PATENT DOCUMENTS

JP S54-098438 U 7/1979
JP H03-086519 A 4/1991
JP H04-057751 A 2/1992
JP H07-267234 A 10/1995
JP H10-7121 A 1/1998
JP H11-504593 A 4/1999
JP 03086519 A * 10/1999 ..... B65D 1/0223
JP 2003-072785 A 3/2003
JP 4137523 B2 8/2008

OTHER PUBLICATIONS

Dec. 3, 2019 International Preliminary Report on Patentability issued in International Patent Application No. PCT/JP2018/009986.
Nov. 24, 2020 Office Action issued in Japanese Patent Application No. 2017-108187.
Feb. 26, 2021 Extended European Search Report issued in European Patent Application No. 18 80 9339.7.

* cited by examiner

SYNTHETIC RESIN CONTAINER

TECHNICAL FIELD

The present disclosure relates to a synthetic resin container that includes a tubular mouth portion and a flattened body connected to the mouth portion and discharges contents when the body is squeezed.

BACKGROUND

As a container configured to contain a variety of types of contents such as foods and cosmetics, a synthetic resin container including a tubular mouth portion and a body connected to the mouth portion and forming a space configured to contain contents has been known (see, for example, Patent Literature 1).

Further, examples of a synthetic resin container used for contents having a relatively high viscosity, for example, include those from which contents contained therein are discharged by squeezing a flexible body. In addition, as illustrated in FIG. 4A, for the purpose of an easy squeezing operation of a container, a container having a body 21 formed into a flattened shape having an oval cross-section is known. Specifically, the body 21 has a front side wall 22 and a rear side wall 23 opposed to each other across a center axis line C in a thickness direction (a short axis direction), and as illustrated by arrows in FIG. 4A, the body 21 can be sandwiched from both sides in the thickness direction and squeezed.

CITATION LIST

Patent Literature

PTL 1: JP4137523 B2

SUMMARY

Technical Problem

However, in the above described container, when the body 21 is squeezed and the front side wall 22 is inverted and deformed toward the rear side wall 23, a gap G is formed at a widthwise end 24 of the body 21 as illustrated in FIG. 4B. Thus contents easily remain in the gap G and it is difficult to use up the contents.

The present disclosure is to solve the above problem, and is to provide a synthetic resin container having a shape that does not allow a gap to be easily formed therein when a body of a flattened container is squeezed so as to reduce the remaining amount of the contents.

Solution to Problem

The disclosed synthetic resin container is a synthetic resin container having a tubular mouth portion and a body connected to the mouth portion and forming a space that contains contents, the body being squeezed to discharge the contents, wherein:

the body has a flattened shape with a width larger than a thickness;

an end on one side in an axial direction along a center axis line of the body is connected to the mouth portion;

an end on another side in the axial direction of the body is closed and has a curved shape protruding to the another side in the axial direction;

widthwise ends on both sides of the body are provided respectively with bent portions extending in parallel with the axial direction; and when the body is squeezed in a thickness direction to discharge the contents, the bent portion is a starting point when one of a front side wall and a rear side wall opposed to each other in a thickness direction of the body is inverted and deformed toward the other.

According to the disclosed synthetic resin container, in a planar view from the axial direction, it is preferable that an angle formed by a tangent to the front side wall starting from a top of the bent portion and a tangent to the rear side wall starting from the top is 140° or less.

Further, in the disclosed synthetic resin container, the flatness of the body may preferably be not less than 1.2 and not more than 1.8.

According to the disclosed synthetic resin container, in a side view from an extending direction of a long axis of the body, it is preferable that a contour line of the end on the another side in the axial direction is located inside a semicircular virtual arc that passes through a center point of the end on the another side located on the center axis line and has a maximum thickness of the body as a diameter.

According to the disclosed synthetic resin container, in a front view from an extending direction of a short axis of the body, it is preferable that a contour line of the end on the another side in the axial direction is a substantially semicircular shape with the maximum width of the body as a diameter.

Advantageous Effect

According to the present disclosure, a synthetic resin container having a shape that does not allow a gap to be easily formed therein when a body of a flattened container is squeezed so as to reduce a remaining amount of the contents can be provided.

DETAILED DESCRIPTION

Figure 1:
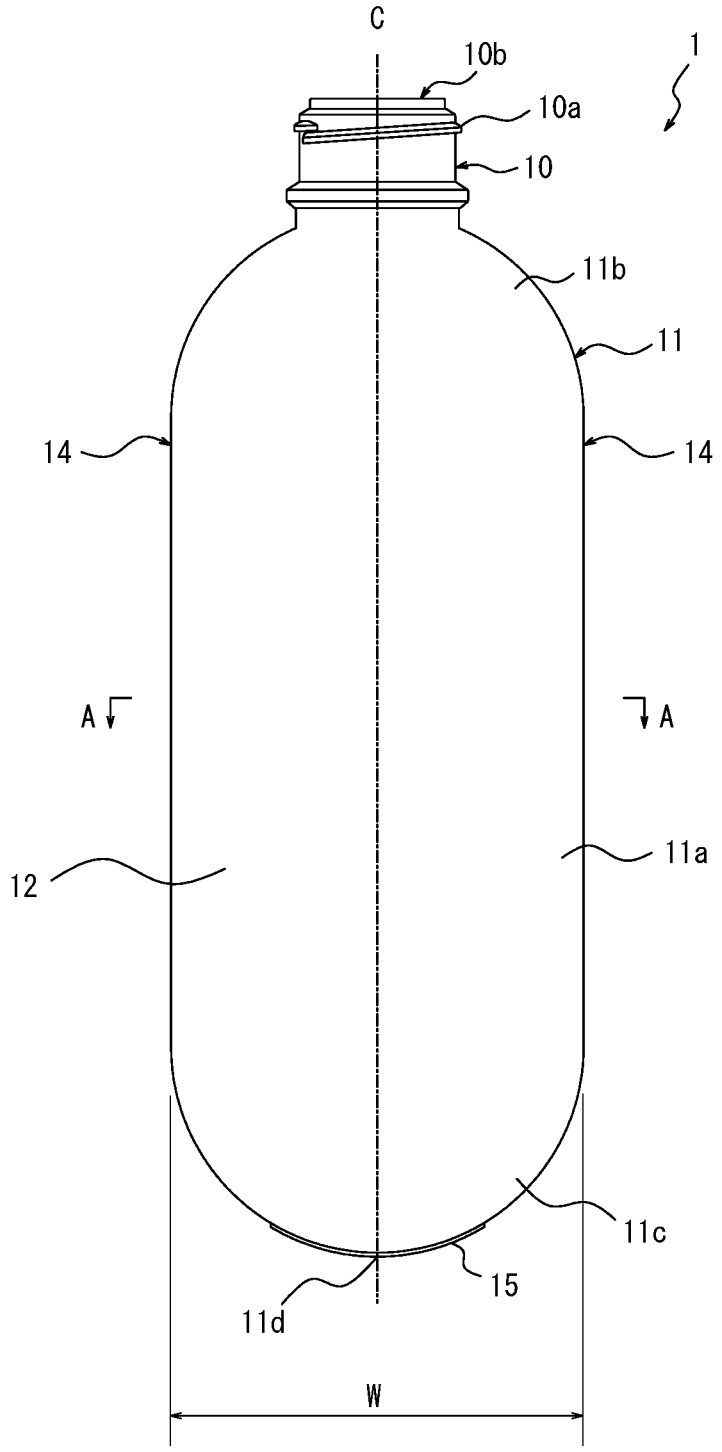
FIG. 1 is a front view of a synthetic resin container according to an embodiment of the present disclosure.

The present disclosure will be illustrated in more detail below with reference to the drawings.

A synthetic resin container 1 (hereinafter also referred to as "container 1") according to the present embodiment illustrated in FIGS. 1 to 3 includes a tubular mouth portion 10 and a body 11 connected to the mouth portion 10 and forming a space S that contains contents. In the present embodiment, the mouth portion 10 is formed into a cylindrical shape and an outer periphery thereof is provided with a male thread 10*a* to which a cap or the like can be fitted.

Further, a top opening 10*b* of the mouth portion 10 is provided as a discharge port for the contents.

The body 11 has a flattened shape with the width W larger than the thickness. The body 11 has a flexibility and is configured to be able to be squeezed in the thickness (short axis) direction when the contents are discharged. The body 11 has a tubular central portion 11*a* whose cross-sectional shape is constant. Further, an end 11*b* on one side in the axial direction along the center axis line C of the body 11 is connected to the mouth portion 10, a diameter of the end 11*b* being gradually decreased from a portion connected to the central portion 11*a*. Further, a diameter of an end (closed end) 11*c* on another side in the axial direction of the body 11 is gradually decreased toward the bottom, and is closed at the bottom. Thus the closed end 11*c* entirely swells downward into a curved shape. In this manner, in the container 1 according to the present embodiment, the entire closed end 11*c* swells downward into a curved shape, and as a result, compared with a container whose lower end of the body is closed by a bottom wall that is vertical to the center axis line, the body 11 is easily squeezed in the thickness direction.

The body 11 has a front side wall 12 and a rear side wall 13 opposed to each other across the center axis line C in the thickness direction. Further, widthwise ends on both sides of the body 11, that is, a boundary between the front side wall 12 and the rear side wall 13, are respectively provided with bent portions 14 extending in parallel with the axial direction of the body 11. The bent portion 14 is configured to be a starting point when the body 11 is squeezed in the thickness direction and one of the front side wall 12 and the rear side wall 13 is inverted and deformed toward the other.

In this example, the bent portion 14 extends linearly along a parting line PL of a mold. In a side view of the container 1 illustrated in FIG. 2, the parting line PL of the container 1 formed by a division face of the mold is illustrated over the center axis line C.

Figure 3B:
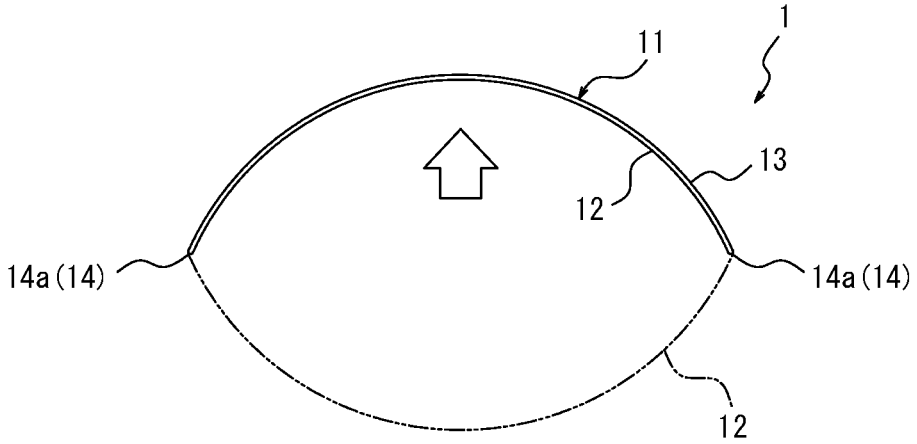
FIG. 3B is a cross sectional view along A-A section in FIG. 1 in a state where a body is squeezed.
Figure 4A:
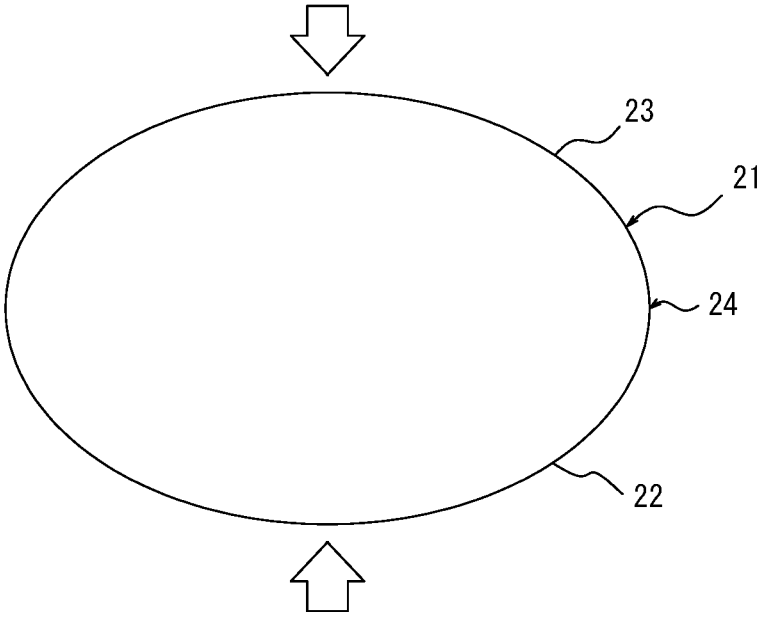
FIG. 4A is a cross-sectional view of a body of a flattened container as a comparative example.
Figure 4B:
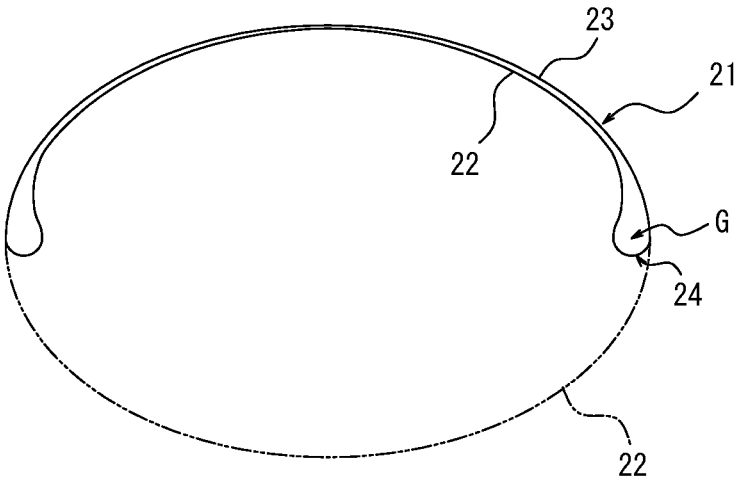
FIG. 4B is a cross-sectional view of the body of the container in FIG. 4A in a state where the body is squeezed.

When the contents contained in a space S of the container 1 is discharged from the top opening 10*b* of the mouth portion 10, the front side wall 12 and the rear side wall 13 of the body 11 is sandwiched from both sides so that they are squeezed in the thickness direction. When the body 11 of the container 1 is squeezed in the thickness direction, as illustrated in FIG. 3B, either one of the front side wall 12 and the rear side wall 13 (the front side wall 12 in the illustrated example) is inverted and deformed toward the other (the rear side wall 13 in the illustrated example). Further, when inverted and deformed, the ends on both sides in the width direction of the body 11 can be folded at a sharp angle with the bent portions 14 located on both ends in the width direction as a starting point, which makes it difficult to form a space like a gap G illustrated in FIG. 4B, and as a result the amount of contents remaining in the space S can be reduced. In particular, the contents remaining in the container increases as the viscosity of the contents in the container increases, which makes it difficult to use up the contents in the container. Thus it is more effective for the container 1 according to the present embodiment to be used for contents with a high viscosity.

According to the container 1 of the present embodiment, in a front view from the extending direction (thickness direction) of the short axis of the body 11 as illustrated in FIG. 1, the contour line of the closed end 11*c* of the body 11 has a substantially semicircular shape with a maximum width W of the body 11 as a diameter. In this manner, smoother inversion and deformation is possible when the closed end 11*c* is squeezed in the thickness direction, and the shape resulting from the inversion and deformation can be maintained easily. As a result, an effect of the present disclosure, which is a reduction in the amount of contents remaining in the space S, can be enhanced.

Figure 2:
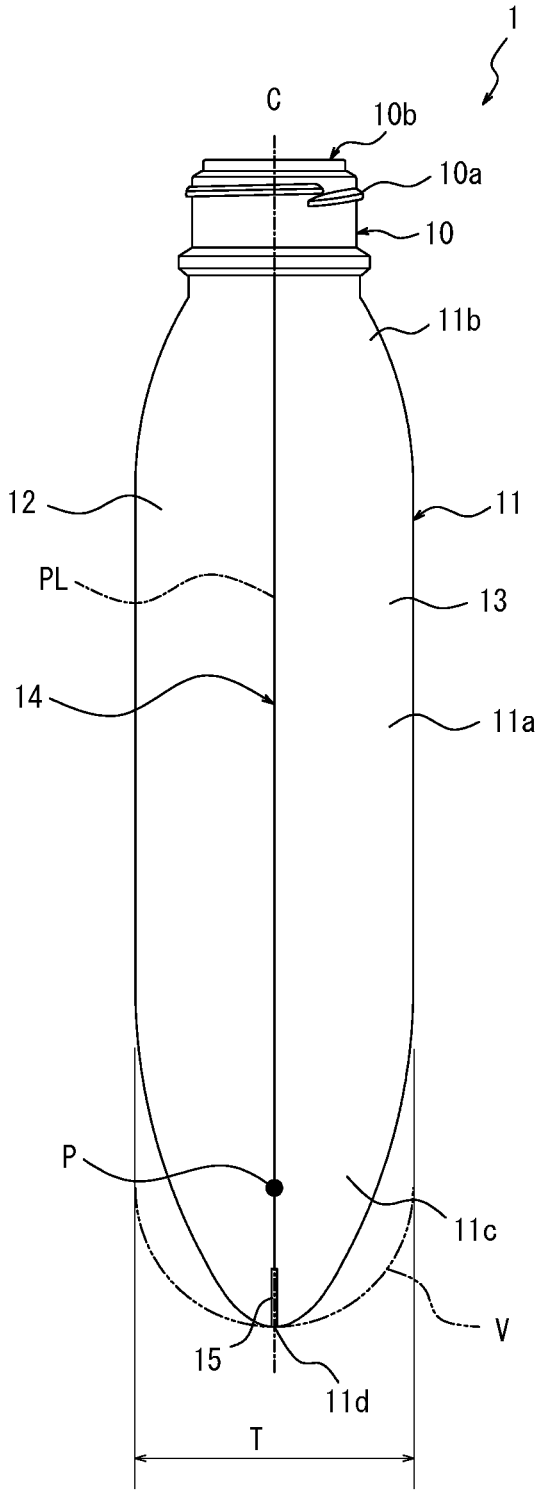
FIG. 2 is a side view of the synthetic resin container in FIG. 1.

As illustrated in FIG. 2, in a side view from the extending direction of the long axis of the body 11, the contour line of the closed end 11*c* of the body 11 is located inside the virtual arc V. The virtual arc V is a semicircular arc that passes through a center point 11*d* of the closed end 11*c* located on the center axis line C (lower end of the closed end 11*c*) and has a maximum thickness T of the body 11 as a diameter. The center of curvature P of the virtual arc V is located on the center axis line C of the body 11. In this manner, the contour line of the closed end 11*c* is located inside the virtual arc V, which allows for smoother inversion and deformation when the closed end 11*c* is squeezed in the thickness direction and easy maintenance of the shape resulting from the inversion and deformation. As a result, an effect of the present disclosure, which is a reduction in the amount of contents remaining in the space S, can be enhanced.

Figure 3A:
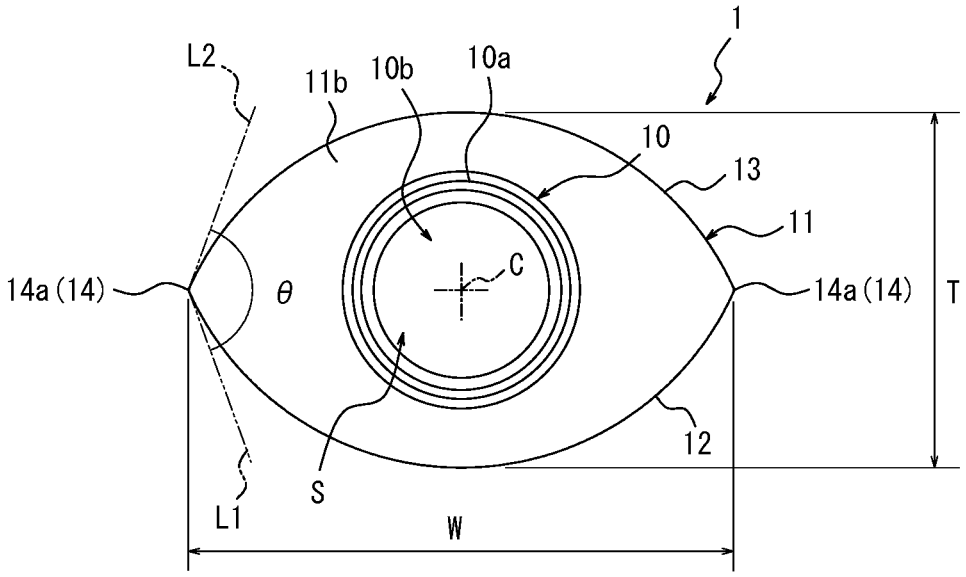
FIG. 3A is a plan view of the synthetic resin container in FIG. 1.

As illustrated in FIG. 3A, in a plan view from the axial direction of the container 1, it is preferable that an angle formed by a tangent L1 to the front side wall 12 starting from a top 14*a* of the bent portion 14 and a tangent L2 to the rear side wall 13 starting from the top 14*a* of the bent portion 14 is 140° or less. The above described configuration allows for smoother inversion and deformation of the body 11 and easy maintenance of the shape resulting from the inversion and deformation. As a result, an effect of the present disclosure, which is a reduction in the amount of contents contained in the space S, can be enhanced.

The flatness of the body 11 may preferably be not less than 1.2 and not more than 1.8. With this configuration, the body 11 can be squeezed more smoothly and inverted and deformed, and the shape resulting from the inversion and deformation can be maintained easily. Furthermore, an extreme reduction in volume of the contents in the space S is prevented, and an appropriate amount of contents in the container can be ensured. In this context, the flatness of the body 11 is a value represented by a ratio of the maximum width W of the body 11 to the maximum thickness T of the body 11. That is, the flatness is a value resulting from the equation of flatness=W/T. In this example, the maximum thickness of the body 11 is 47 mm and the maximum width of the body 11 is 71 mm. Thus the flatness is 1.51.

In this example, the body 11 has the front side wall 12 and the rear side wall 13 in a shape symmetrical to the plane that passes through the center axis line C and the long axis of the body 11. That is, in this example, the body 11 has a shape symmetrical in the thickness direction (front-back direction). In this manner, when either one of the front side wall 12 and the rear side wall 13 of the body 11 is inverted and deformed toward the other, a gap formed between the front side wall 12 and the rear side wall 13 is reduced, and as a result an amount of the contents remaining in the space S can be further reduced.

Further, in this example, the body 11 is symmetrical about the plane that passes through the center axis line C and the short axis of the body 11. That is, in this example, the body 11 is formed in a shape symmetrical about the width direction (right-left direction). As a result a right and left balance of the body 11 is achieved between right and left, and a failure of squeezing of the body 11 unbalanced between right and left can be suppressed, which allows for an easier squeezing operation of the entire body 11. It is to be noted that the body 11 may be asymmetrical in the front-rear direction and the right-left direction.

The container 1 can be obtained by the extrusion blow molding in which a tubular parison formed by olefin synthetic resin such as PP, PE (LDPE), for example, is used. In this example, a pinch-off portion 15 formed by cutoff of a sprit mold for blow molding is provided to the closed end 11*c*. It is to be noted the manufacturing method of the container 1 is not limited thereto, and a variety of methods can be adopted.

The above description is merely an embodiment of the present disclosure, and various changes may be made to the claims. For example, in the above described embodiment, although the body 11 is formed into a smoothly curved shape to obtain a substantially oval shape excepting the bent portion 14, a bent portion or recess and protrusion may be provided to the front side wall 12 and the rear side wall 13. Further, the container 1 may be provided as a double container having an outer layer body forming an outline of the container and an inner layer body provided inside the outer layer body. In this case, an atmospheric air introduction hole is formed in the mouth portion or the body of the outer layer body to introduce atmospheric air into between the outer layer body and the inner layer body. Further, when the container 1 is provided as a double container, the container can be formed by the extrusion blow molding in which a tubular parison is used. The parison is formed by laminating a synthetic resin forming the outer layer body and a synthetic resin forming the inner layer body that has a low compatibility with the synthetic resin forming the outer layer body. In that case, for example, the outer layer body may be formed of polypropylene resin (PP) and the inner layer body may be formed of ethylene vinyl alcohol copolymer (EVOH). The above described layer configuration is an example, and the materials of the outer layer body and the inner layer body are not limited as far as the inner layer body is separable from the outer layer body. Each of the outer layer body and the inner layer body may be provided as a single layer structure, or the inner layer body may have a multi-layer structure formed of multiple layers such as "EVOH/adhesive/olefin," "nylon/adhesive/olefin" or the like.

REFERENCE SIGNS LIST

1 synthetic resin container
10 mouth portion
11 body
11*a* central portion of the body
11*b* end on one side in the axial direction of the body
11*c* end (closed end) on the other side in the axial direction of the body
12 front side wall
13 rear side wall
14 bent portion
C center axis line
S space

The invention claimed is:

1. A synthetic resin container formed by extrusion blow molding, the synthetic resin container comprising:

a tubular mouth portion; and a body connected to the mouth portion and forming a space that contains contents, the body being configured to be squeezed to discharge the contents, the body having a flattened shape with a width larger than a thickness, wherein:

an axial end on a first side of the body in an axial direction along a center axis line of the body is connected to the mouth portion;

an axial end on a second side of the body in the axial direction of the body is closed, the axial end of the second side having an entirely curved shape protruding towards the second side of the body in the axial direction, the axial end on the second side having a pinch-off portion formed on a bottom of the axial end of the second side, the pinch-off portion being formed from excess material cutoff of a sprit mold during blow molding of the container, and the curved shape of the axial end of the second side is convex and protrudes such that the thickness of the body decreases along the axial direction of the body towards the pinch-off portion on the axial end of the second side;

a first widthwise end and a second widthwise end respectively located on each side of the body are provided respectively with parting lines formed by a division face of a mold of the synthetic resin container and provided respectively with bent portions extending in parallel with the axial direction;

the bent portions are overlapped with the parting lines; and when the body is squeezed in a thickness direction of the body to discharge the contents, each bent portion is configured to be a starting point when one of a front side wall and a rear side wall opposed to each other in the thickness direction of the body is inverted and deformed toward the other one of the front side wall and the rear side wall.

2. The synthetic resin container according to claim 1, wherein, in a planar view from the axial direction, an angle formed by a tangent to the front side wall starting from a top of the bent portion and a tangent to the rear side wall starting from the top is 140° or less.

3. The synthetic resin container according to claim 1, wherein a flatness of the body defined as a value represented by a ratio of a maximum width of the body to a maximum thickness of the body is not less than 1.2 and not more than 1.8.

4. The synthetic resin container according to claim 1, wherein, in a side view from an extending direction of a long axis of the body, a contour line of the axial end on the second side in the axial direction is located inside a semicircular virtual arc that passes through a center point of the axial end on the second side located on the center axis line and has a maximum thickness of the body as a diameter.

5. The synthetic resin container according to claim 1, wherein, in a front view from an extending direction of a short axis of the body, a contour line of the axial end on the second side in the axial direction is a substantially semicircular with a maximum width of the body as a diameter.

6. The synthetic resin container according to claim 2, wherein a flatness of the body defined as a value represented by a ratio of a maximum width of the body to the maximum thickness of the body is not less than 1.2 and not more than 1.8.

7. The synthetic resin container according to claim 2, wherein, in a side view from an extending direction of a long axis of the body, a contour line of the axial end on the second side in the axial direction is located inside a semicircular virtual arc that passes through a center point of the axial end on the second side located on the center axis line and has a maximum thickness of the body as a diameter.

8. The synthetic resin container according to claim 3, wherein, in a side view from an extending direction of a long axis of the body, a contour line of the axial end on the second side in the axial direction is located inside a semicircular virtual arc that passes through a center point of the axial end on the second side located on the center axis line and has the maximum thickness of the body as a diameter.

9. The synthetic resin container according to claim 6, wherein, in a side view from an extending direction of a long axis of the body, a contour line of the axial end on the second side in the axial direction is located inside a semicircular virtual arc that passes through a center point of the axial end on the second side located on the center axis line and has the maximum thickness of the body as a diameter.

10. The synthetic resin container according to claim 2, wherein, in a front view from an extending direction of a short axis of the body, a contour line of the axial end on the second side in the axial direction is semicircular with a maximum width of the body as a diameter.

11. The synthetic resin container according to claim 3, wherein, in a front view from an extending direction of a short axis of the body, a contour line of the axial end on the second side in the axial direction is semicircular with the maximum width of the body as a diameter.

12. The synthetic resin container according to claim 6, wherein, in a front view from an extending direction of a short axis of the body, a contour line of the axial end on the second side in the axial direction is semicircular with the maximum width of the body as a diameter.

13. The synthetic resin container according to claim 4, wherein, in a front view from an extending direction of a short axis of the body, a contour line of the axial end on the second side in the axial direction is semicircular with a maximum width of the body as a diameter.

14. The synthetic resin container according to claim 7, wherein, in a front view from an extending direction of a short axis of the body, a contour line of the axial end on the second side in the axial direction is semicircular with a maximum width of the body as a diameter.

15. The synthetic resin container according to claim 8, wherein, in a front view from an extending direction of a short axis of the body, a contour line of the axial end on the second side in the axial direction is semicircular with the maximum width of the body as a diameter.

16. The synthetic resin container according to claim 9, wherein, in a front view from an extending direction of a short axis of the body, a contour line of the axial end on the second side in the axial direction is semicircular with the maximum width of the body as a diameter.

* * * * *